United States Patent [19]

Wilson

[11] Patent Number: 4,830,267

[45] Date of Patent: May 16, 1989

[54] HANDLE STRUCTURE FOR WRAPAROUND CARRIER

[75] Inventor: Jerry F. Wilson, West Monroe, La.

[73] Assignee: Manville Corporation, Denver, Colo.

[21] Appl. No.: 44,871

[22] Filed: Apr. 30, 1987

Related U.S. Application Data

[63] Continuation of Ser. No. 847,128, Apr. 1, 1986, which is a continuation of Ser. No. 715,216, Mar. 22, 1985.

[51] Int. Cl.[4] ..... B65D 5/46

[52] U.S. Cl. ..... 229/52 BC; 229/52 B; 206/141; 206/427

[58] Field of Search ..... 206/141, 142, 143, 427, 206/428; 229/27, 40, 52 B, 52 BC

[56] References Cited

U.S. PATENT DOCUMENTS

| | | | |
|---|---|---|---|
| 3,974,911 | 8/1976 | Graser | 206/141 |
| 3,994,432 | 11/1976 | Kirby, Jr. | 229/52 BC |
| 4,222,485 | 9/1980 | Focke | 229/52 B |
| 4,318,474 | 3/1982 | Hasegawa | 229/52 B |
| 4,397,393 | 8/1983 | Pergande et al. | 229/52 B |
| 4,508,258 | 4/1985 | Graser | 229/52 B |

*Primary Examiner*—David T. Fidei

*Attorney, Agent, or Firm*—John D. Lister; Cornelius P. Quinn

[57] ABSTRACT

A wrap-around carrier for transporting a plurality of beverage containers and including a drop-down partition for separating containers is provided with an improved, handle reinforcement section to provide at least double ply thickness in all areas surrounding the handle openings.

1 Claim, 2 Drawing Sheets

HANDLE STRUCTURE FOR WRAPAROUND CARRIER

This is a continuation of application Ser. No. 06/847,128, filed Apr. 1, 1986 which is a Continuation of application Ser. No. 06/715,216, filed Mar. 22, 1985.

BACKGROUND OF THE INVENTION

1. Field of the Invention

The present invention is generally directed to a wraparound carrier for carrying a plurality of beverage containers. In particular the invention is directed to a reinforced handle structure for such a carrier in which a drop-down partition is formed from a portion of the inner top panel.

2. Description of the Prior Art

Carriers with drop-down partitions formed from the inner top panel of the carrier have been in commerical use for a number of years as illustrated by U.S. Pat. Nos. 4,043,095, and 4,155,449. One problem associated with such carriers is that, in using one of the layers of paperboard to form the drop-down partition, only a single ply of paperboard was left in some areas surrounding the handle. These are the areas in which tearing and failure are most likely to occur. Heavier paperboard has been used in an attempt to overcome this problem. However, heavier paperboard is more expensive and the entire carrier must be made of the heavier paperboard when it may not be needed on most of the carrier except for the handle area.

FIG. 2 of this application illustrates the handle structure of a carrier which has been marketed prior to the present invention. In that carrier, the design allows for double or triple ply thicknesses in some areas around the handle openings. However, other areas around the handle openings are only of a single ply thickness. As long as this carrier was fabricated from paperboard of a sufficient thickness it performed satisfactorily. However, to reduce the cost of the package and make the package commercially more competitive, it is desirable to fabricate such carriers from as light a weight paperboard as possible without losing the desired performance characteristics of the carrier.

It is an object of the present invention to enable carriers with drop-down partitions of the type described above to be made out of lighter weight paperboard without adversely affecting the performance characteristic of the carrier. In fact the use of the present invention has permitted these carriers to be made from 24 point paperboard when carriers using a handle structure such as that illustrated in FIG. 2 of this application were made from 27 point paperboard.

SUMMARY OF THE INVENTION

The present invention accomplishes the above objectives by providing a reinforced handle structure which provides at least a double thickness of paperboard at critical stress areas adjacent the handle openings in the carrier top. A handle reinforcement section is provided adjacent the handle openings to provide the double ply thickness. The present invention and the advantages of the invention will be more apparent from the following description of the preferred embodiment with reference to the accompanying drawings.

DESCRIPTION OF THE PREFERRED EMBODIMENT

Figure 1:
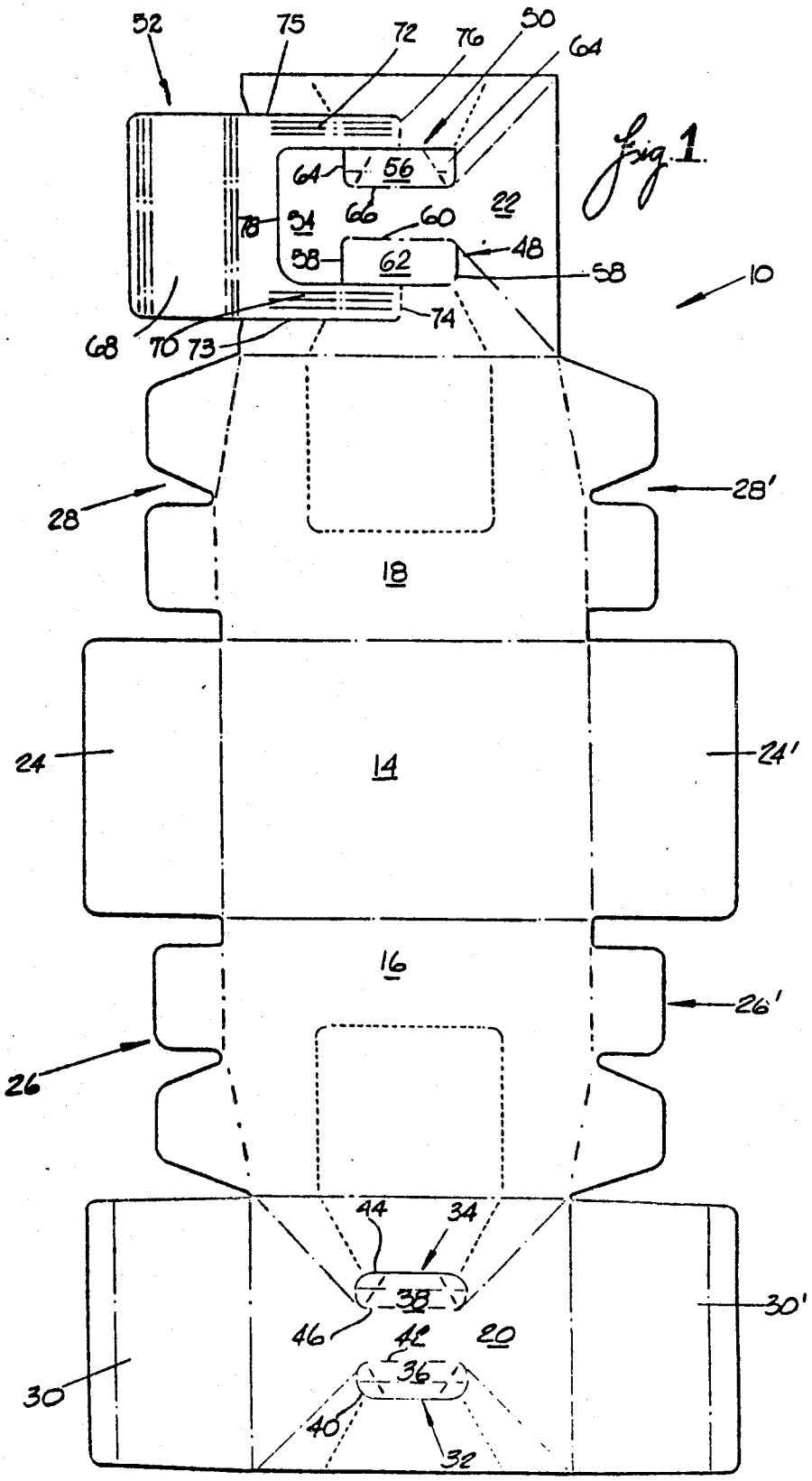
FIG. 1 is a plan view of the carrier blank of the present invention.

FIG. 1 illustrates the blank 10 of the present invention which may be folded and adhesively bonded together to form a carrier. The blank 10 comprises a bottom panel 14, side panels 16 and 18, outer top panel 20, inner top panel 22, and end panels 24, 24', 26, 26', 28, 28' and 30, 30'.

The outer top panel 20 includes a pair of elongated, spaced-apart handle openings 32 and 34 provided with handle tabs 36 and 38. Handle opening 32 and handle tab 36 are defined by a die cut 40 and a fold line 42. Handle opening 34 and handle tab 38 are defined by a die cut 44 and a fold line 46. The handle tabs 36 and 38 are hingedly attached to the outer top panel 20 along the fold lines 42 and 46 respectively.

The inner top panel 22 includes a pair of elongated, spaced-apart handle openings 48 and 50, a drop-down portion 52 and a handle reinforcement section 54. The handle opening 48 and handle tab 56 are defined by a die cut 58 and fold line 60. The handle opening 50 and reinforcement tab 62 are defined by die cut 64 and fold line 66.

The drop-down portion 52 comprises a main partition portion 68 and a pair of connecting strips 70 and 72. The connecting strips 70 and 72 are hingedly joined to the inside top panel 22 along fold lines 74 and 76 which are aligned with the transverse centerlines of handle openings 48 and 50. Die cuts 73 and 75 along with die cut 78 define drop-down portion 52 from top panel 22.

The handle reinforcement section 54 of the inner top panel 22 is defined in part and adjacent the handle openings 48 and 50 by die cuts 58 and 64 which also define the inner edge portions of partition straps (70, 72). The remaining edge of the handle reinforcement section 54 is defined by a generally U-shaped die cut 78 which also defines a major portion of the upper edge of the main partition portion 68. The width of the handle reinforcement section 54 is equal to the distance between the outer edges of the handle openings 48 and 50 so that the reinforcement section 54 extends across the entire width of each of the handle openings 48 and 50. Prior art reinforcement such as that shown in U.S. Pat. No. 4,043,095 extended only across a portion of the width of the handle openings.

Figure 3:
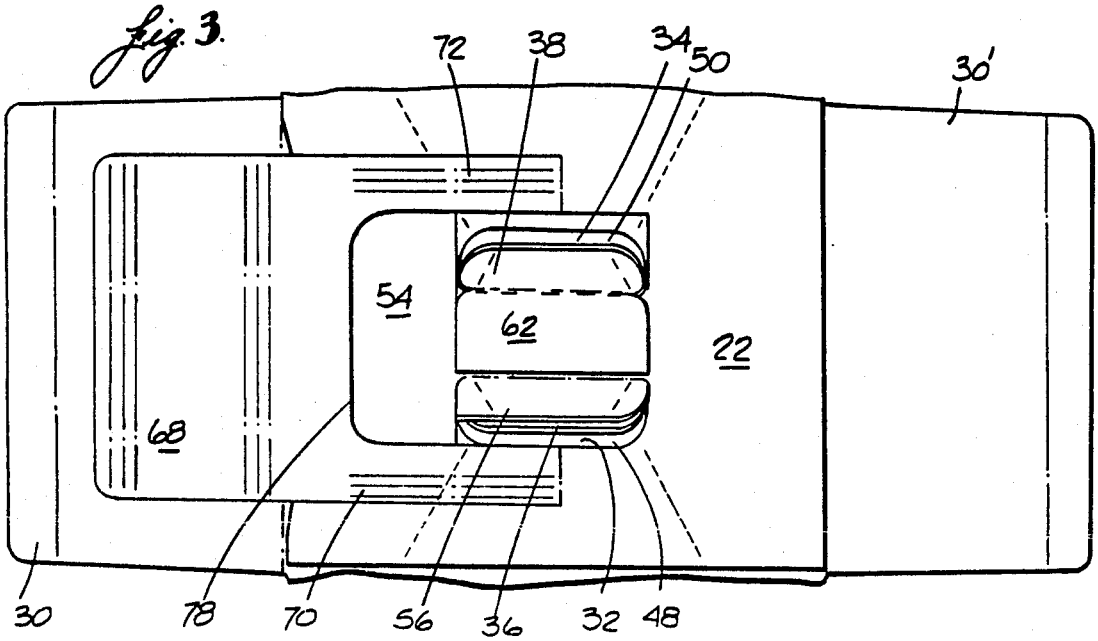
FIG. 3 is a view of the inside of the adhesively bonded top panels of the carrier of the present invention.

When the blank 10 is formed into a carrier 12, the outer and inner top panels 20 and 22 are adhesively bonded together as shown in FIG. 3. As shown in FIG. 3, the outer top panel 20 overlays the inner top panel 22 and the panels are essentially coextensive. The handle openings 32 and 34 of the outer top panel 20 and the handle openings 48 and 50 of the inner top panel 22 are aligned in both the transverse and longitudinal directions. Handle tabs 36, 38, 56 are bent inwardly as shown. The reinforcement tab 62 of the inner top panel 22 is folded back onto and adhesively bonded to the inner top panel 22 to form a three-ply handle portion between handle openings 32, 48 and 34, 50. The width of the reinforcing tab 62 corresponds to the distance between the inner edges of the handle openings 48 and 50. The ends of the handle openings 48 and 50 coincide with the ends of the handle openings 32 and 34. Thus, the areas to the left and right of the handle openings 32, 48 and 34, 50 in FIG. 3 are of double ply construction completely across the width of the handle openings to prevent tearing or failure of the handle. The reinforcement section 54 which is cut from the partition permits this reinforcement of the carrier on the left side in FIG. 3 while the double layer of outer top panel 20 and inner top panel 22 provide the double ply on the right side. Prior art carriers did not provide for a double ply of board across the entire width of the left side of handle openings 32, 48 and 34, 50. Reinforcement tab 62 bonded to inner top panel 22 (which is itself bonded to outer top panel 20) provides a triple ply layer between handle openings 34, 50 and 32, 48.

Figure 2:
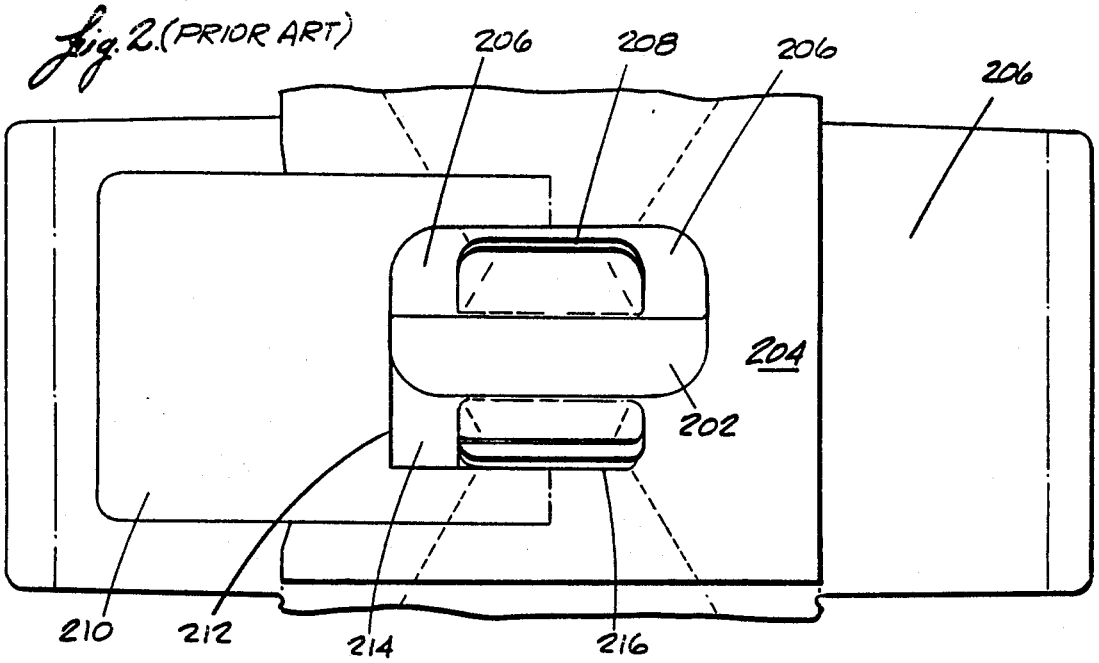
Fig. 2. (PRIOR ART)
FIG. 2 is a view of the inside of the adhesively bonded top panels of a prior art carrier.

Referring to FIG. 2, in which a prior art handle structure is illustrated, reinforcing tab 202 is folded over and adhesively secured to inner top panel 204 which is adhesively secured to outer top panel 206. Thus, a triple ply is provided in the area covered by 202. A drop down partition 210 has an upper edge defined by die cut 212. A reinforcement tab 214 on inner top panel 204 provides some reinforcement in handle area 216. However, in the critical areas to the right and left of handle opening 208, there is only a single ply of board (outer top panel 206).

Thus, comparing FIG. 3 to FIG. 2 it can be seen that handle reinforcement section 54 provides double ply thickness around the handle openings 34, 50 and 32, 48 as opposed to prior art such as illustrated in FIG. 2 which provided only single ply thickness around some areas of the handle openings. Because at least double ply thicknesses are provided, a thinner paperboard such as 24 point paperboard may be advantageously employed as opposed to the prior art carriers which required 27 point paperboard. Thus, savings in weight and cost are achieved with the novel construction of the present invention.

While the invention has been described with respect to a preferred embodiment thereof it is not to be so limited as changes and modifications may be made which are within the full intended scope of the invention as defined by the appended claims.

What is claimed is:

1. A wrap-around carrier for transporting a plurality of beverage containers, said carrier including a bottom panel, a pair of side panels, a plurality of end panels and a pair of overlapping top panels which panels form a package enclosing said plurality of beverage containers;

said top panels including an outer top panel and an inner top panel, said inner and outer top panels being substantially coextensive, with said outer top panel overlying said inner top panel and being adhesively bonded thereto;

said outer top panel including a pair of elongated outer handle openings therein, said outer handle openings each having a tab hingedly joined to an inner longitudinal edge of the outer handle opening, said tabs adapted to be folded inwardly when fingers are inserted into the outer handle opening to lift the carrier; and said inner top panel including a pair of elongated inner handle openings which are aligned with and substantially the same size as the outer handle openings, said inner handle openings each having a tab hingedly joined to an inner longitudinal edge of the inner handle opening with one of said inner tabs being folded back onto and adhesively bonded to the inner top panel, the width of said folded-back inner handle tab being substantially equal to the distance between the inner longitudinal edges of said inner handle openings, whereby the folded-back inner handle tab and the portions of the outer and inner top panels between the handle openings provide a three ply layer between the handle openings and the other of said inner handle tabs being adapted to be folded inwardly when fingers are inserted into the inner handle openings to lift the carrier, said inner top panel including a drop-down partition comprising a main partition portion and a pair of spaced straps extending therefrom and being hingedly joined to the inner top panel along fold lines extending parallel to and substantially coextensive with the transverse center lines of the handle openings, the inner facing edges of the straps being substantially aligned with the outer horizontal edges of the inner handle openings so that the distance between the inner facing edges of the straps is substantially the same as the distance between the outer longitudinal edges of the inner handle openings;

said inner top panel including a handle reinforcement section defined on three sides by edges corresponding to the upper edge of the main partition portion and to oppositely facing edge portions of the straps when said main partition portion is in folded-back condition parallel to the inner top panel, the remaining side of the handle reinforcement section being defined by the adjacent ends of the inner handle openings and by the portion of the inner top panel between the inner handle openings, the handle reinforcement section being adhesively bonded to said outer top panel and providing with said outer top panel a two ply layer.

* * * * *